United States Patent [19]

Yun et al.

[11] Patent Number: 5,055,736

[45] Date of Patent: Oct. 8, 1991

[54] SHADOW MASK FOR USE IN A THREE-GUN COLOR PICTURE TUBE

[75] Inventors: Joyung Yun; Hojin Cho, both of Busan, Rep. of Korea

[73] Assignee: Samsung Electron Devices Co., Ltd., Rep. of Korea

[21] Appl. No.: 502,127

[22] Filed: Mar. 30, 1990

[51] Int. Cl.[5] ..... H01J 29/07

[52] U.S. Cl. ..... 313/402; 313/408

[58] Field of Search ..... 313/402, 408, 461, 407, 313/403

[56] References Cited

U.S. PATENT DOCUMENTS

| | | | |
|---|---|---|---|
| 4,210,842 | 7/1980 | Nakayama et al. | 313/403 |
| 4,626,737 | 12/1986 | Takenaka et al. | 313/402 |

FOREIGN PATENT DOCUMENTS

| | | | |
|---|---|---|---|
| 0321202 | 6/1989 | European Pat. Off. | 313/402 |
| 0048463 | 4/1972 | Japan | 313/402 |
| 0112053 | 9/1978 | Japan | 313/402 |
| 0194437 | 11/1982 | Japan | 313/402 |

*Primary Examiner*—Palmer C. DeMeo
*Assistant Examiner*—Nimeshkumar D. Patel
*Attorney, Agent, or Firm*—Cushman, Darby & Cushman

[57] ABSTRACT

A shadow mask for use in a three-gun color picture tube comprising a number of electron beam transmission holes, the length of the bridge portion between two vertically adjacent ones of said electron beam transmission holes being constant, the vertical pitch of said electron beam transmission holes being varied between $Py+\Delta x$ and $Py-\Delta x$ so as to reduce moire effect, $\Delta x$ being obtained from the following formula when $n=3$, 4:

$$\text{moire wavelength} = \frac{1}{\left|\frac{2}{Py} - \frac{n}{2Ps}\right|} = \frac{1}{|fa - fs|},$$

wherein Py is the vertical pitch of the electron beam transmission holes of a shadow mask, Ps the pitch of scanning lines, fa the pitch frequency of the shadow mask, and fs the scanning frequency.

7 Claims, 4 Drawing Sheets

SHADOW MASK FOR USE IN A THREE-GUN COLOR PICTURE TUBE

BACKGROUND OF THE INVENTION

The present invention concerns a shadow mask, and more particularly a pattern of electron beam transmission holes of the shadow mask.

Generally, a three-gun color picture tube comprises, as shown in FIG. 1, a three-gun assembly 8 of three electron guns 9 arranged linearly or in a triangular form, a deflecting system 6 for deflecting the electron beams emitted from the three-gun assembly, a shadow mask 3 having a number of electron beam transmission holes 5, and a panel 1. The electron beams 7 passing the holes 5 strike the color phosphors of red, green and blue deposited on the inner surface 2 (screen) of the panel 1.

The shape of the phosphor corresponds to that of the electron beam transmission hole 5, and the mutual positions of the three color phosphors 4, struck by three electron beams 7 passing one hole 5, correspond to the arrangement of the three electron guns 9.

The arrangement of the color phosphors 4 on the screen 2 is determined by the arrangement of the electron beam transmission holes 5 in the shadow mask 3.

Usually, the electron beam transmission holes 5 have a circular or a rectangular shape. The rectangular holes are generally arranged as shown in FIG. 2. The holes 5 have the vertical pitch Py, separated from each other by width b of bridge 10. The pitch of two adjacent rows of the holes are vertically offset from each other by the amount of $\Delta y$.

The transmissivity of the electron beams passing through the holes is maximum when the scanning lines 11 pass the centers of the holes, and minimum when the centerline between two adjacent scanning lines 11 corresponds to the center of the holes 5, respectively as shown in FIGS. 3A and 3B. This is represented by the following formula:

$$n\left(Ps - \frac{Py}{2}\right) = \frac{Ps}{2};\ n = \frac{1}{2 - \frac{Py}{Ps}} \tag{1}$$

where Ps represents the pitch of the scanning lines, Py the vertical pitch of the electron beam transmission holes, and n integer.

According to the above formula, the contrast variation having the vertical scanning period of $2n-1$, i.e., moire period is determined by the ratio of the vertical pitch Py to the interval h between the scanning lines 11. Also, the relative size of the moire is determined by the ratio of the width of the holes to the width of the scanning lines.

Thus, the interference between the vertical arrangement of the holes in the shadow mask and the scanning lines causes undulated patterns, i.e. moire effect to appear on the screen 2.

In order to reduce the moire effect, there have been many researches, one of which is dislcosed in the U.S. Pat. No. 4,210,842. According to this U.S. Patent, the vertical pitch of the holes is determined so as to reduce the moire pitch according to the broadcasting method, and the mask pattern is determined to obtain the moire phase difference. Then, the vertical pitches of the holes are arbitrarily arranged in the shadow mask so as to scatter the moire pattern. However, this technique greatly enhances the moire effect, and makes the process of producing the shadow mask difficult.

Moreover, the technique for designing a shadow mask specific for NTSC, PAL and SESAM according to the broadcasting methods slightly reduces the moire effect, but cannot resolve the deviations resulting from the overscanning of a set and the size of the electron beams, thereby not considerably reducing the moire effect.

SUMMARY OF THE INVENTION

The object of the present invention is to determine the range of variation of the vertical pitch of holes in a shadow mask so as to reduce the moire effect.

According to the present invention, the range of variation of the vertical pitch of the holes is based on the point where the moire wavelength appears slightly but visibly, considering the relationship between the vertical pitch and the scanning line pitch and the moire wavelength. Then, the range of variation of the vertical pitch is determined to have the maximum value, so that the vertical pitches have different values.

BREIF DESCRIPTION OF THE ATTACHED DRAWINGS

DETAILED DESCRIPTION OF THE INVENTION

The present invention will now be described more specifically with reference to the drawings attached only by way of example.

Figure 1:
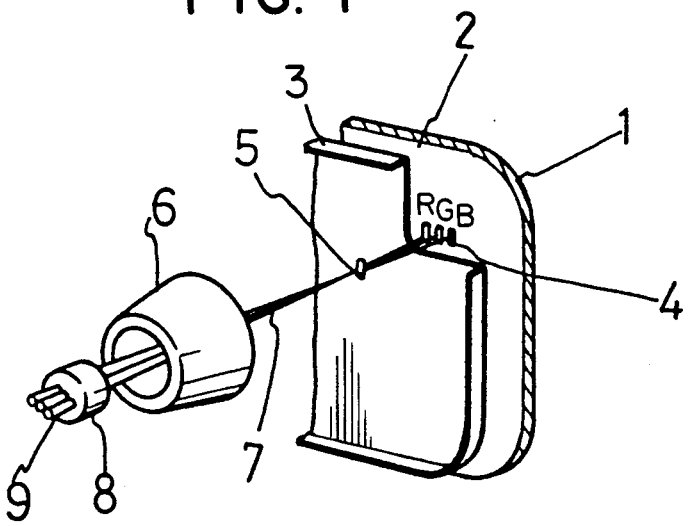
FIG. 1 is a schematic perspective view for illustrating essential parts of a three-gun color picture tube.
Figure 2:
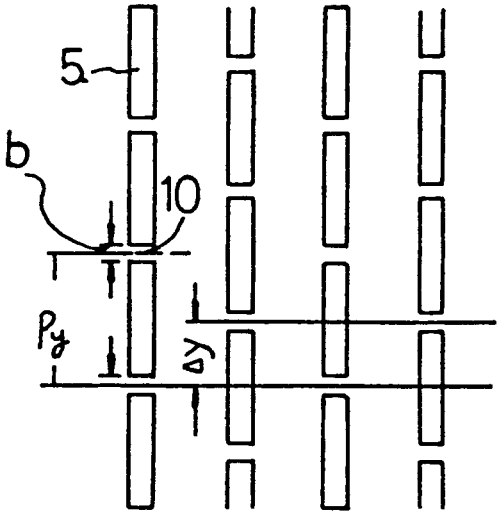
FIG. 2 Prior Art
FIG. 2 illustrates the arrangement of the electron beam transmission holes in a conventional shadow mask.
Figure 3A:
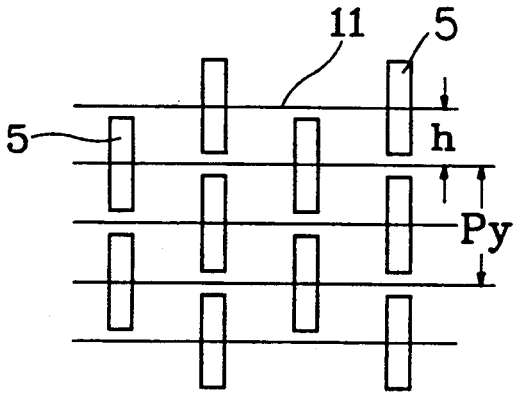
FIGS. 3A and 3B illustrate the relationship between the electron beam transmission holes and the scanning lines.
Figure 3B:
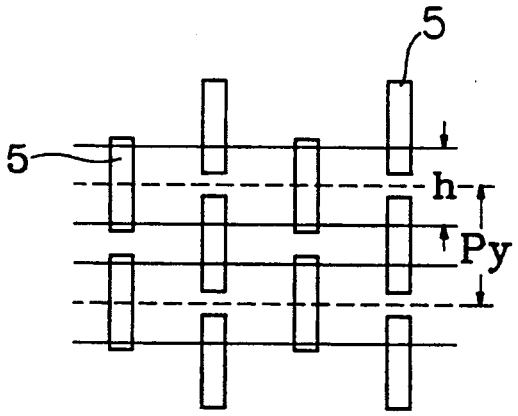
Figure 4:
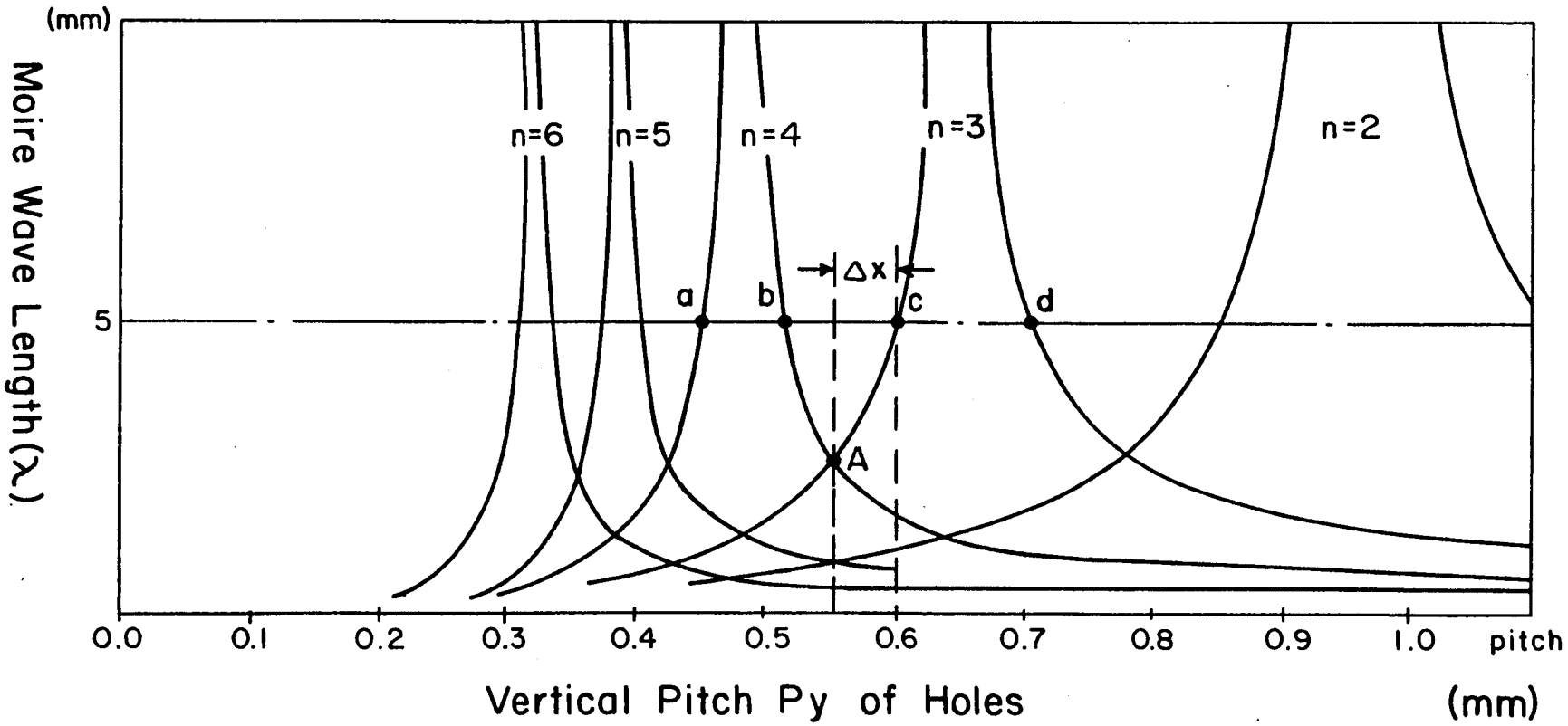
FIG. 4 is graph for illustrating the relationship between the vertical pitch of the holes and the moire wavelength.

Referring FIG. 4, moire frequency fc is represented by Equation (2).

$$fc = |fa - fs| \tag{2}$$

wherein fa is mask pitch frequency, and fs scanning frequency.

On the other hand, $$fc = 1/\lambda (\lambda \text{ represents moire wavelength}) \tag{3}$$

Hence, the moire wavelength is represented by Equation (4).

$$\lambda = \frac{1}{|fa - fs|} = \frac{1}{\left|\frac{2}{Py} - \frac{n}{2Ps}\right|} \tag{4}$$

wherein, Py is the vertical pitch of the shadow mask, Ps the pitch of the scanning lines, and n in a positive integer related to the order of the harmonic of the moire wavelength.

As shown by Equation (4), the moire effect results from the interference between the vertical pitch of the shadow mask and the scanning lines. Namely, the fundamental causes of the moire effect are the vertical pitch of the shadow mask and the scanning lines. Here, the scanning lines are fixed according to the broadcasting method, and therefore, the vertical pitch may be varied to minimize the moire effect so as to obtain an optimum shadow mask. According to the present invention, the vertical pitches of the electron beam transmission holes are variably or randomly arranged in the shadow mask within an established range, so as to reduce the moire wavelength and scatter the moire pattern.

In FIG. 4, the vertical axis represents the magnitude of the moire wavelength λ, and the horizontal axis represents the magnitude of the vertical pitch of the holes. The moire effect is invisible if the moire wavelength is smaller than a certain value, e.g. 5 mm. Hence, if the value of the moire wavelength to visualize the moire effect is 5 mm, the variable range of the vertical pitch may be determined at the integer n=3 and 4 for the moire wavelength intermittently arranged. Namely, the paired traces depicted in FIG. 4 represent successive nth order harmonics of moire wavelengths as a function of the vertical pitch of the holes in the shadow mask and define respective envelopes which intersect in the lower range. At point A the moire effect is invisible, which point is applied to the present invention for defining a nominal vertical hole pitch about which to vary the offset between adjacent vertical rows.

If it is assumed that the variable range of the vertical pitch about point A located at the edges of two intersecting envelopes (for n=3, 4) in order to remain below the 5 mm level of the moire length is 2 Δx, then Δx is the distance between the vertical line through the point A and the point b or c where either envelop intersects the 5 mm level. Although it is preferable for the variable range Δx of the vertical pitch to have the maximum value, the reasonable specific range may be 0.03 mm $\leqq \Delta x \leqq$ 0.05 mm. As the Δx increases, the moire wavelengths are more scattered so as to reduce the moire effect. Hence, the electron beam transmission holes may be vertically arranged by applying the Δx so as to scatter the moire pattern.

EXAMPLE 1

Figure 5A:
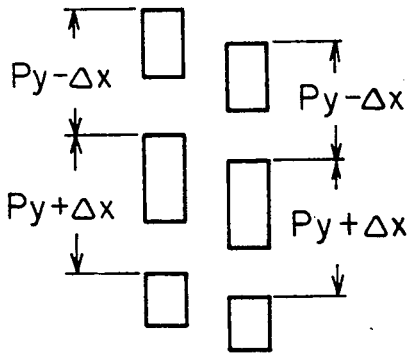
FIGS. 5A and 5B illustrate the shadow mask pattern for arranging the holes according to the present invention.

By applying the variable range Δx of the moire vertical pitch, the electron beam transmission holes are vertically arranged in the shadow mask with S1=Py−Δx, S2=Py+Δx, as shown in FIG. 5A. The bridge b between two vertically adjacent holes is made to have a conventional size.

Py represents the vertical pitch of the holes of the shadow mask designed according to the broadcasting method. Thus, the vertical pitches of the electron beam transmission holes obtained according to the present invention are arranged, as shown in FIG. 5A, in the shadow mask with the two different pitches S1 and S2 vertically alternating. With such an arrangement of the inventive pitches in the shadow mask, the visible moire pattern is upwardly and downwardly scattered so as to reduce the moire effect. Of course, the two vertically adjacent electron beam transmission holes must respectively be relatively small and large so as to maximize the scattering of the moire pattern.

EXAMPLE 2

Figure 5B:
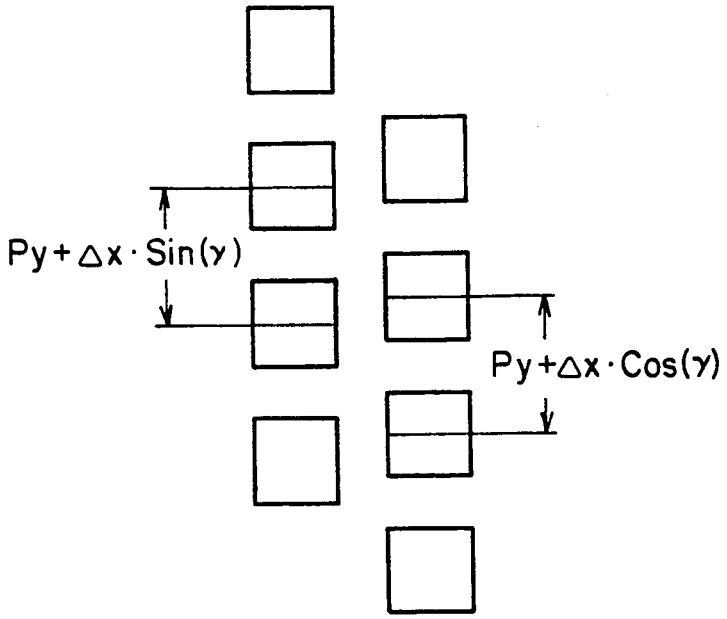

Referring FIG. 5B, the pitches of two vertically adjacent electron beam transmission holes are designed to have respectively the values of S1=Py+Δx sin (r) and S2=Py+Δx cos (r). The bridge b between two vertically adjacent holes is made to have a conventional size. The r in the formula represents an arbitrarily measured vertical distance of a screen.

As in Example 1, the vertical pitches are arranged in the shadow mask with the two different pitches S1 and S2 vertically alternating so as to maximize the scattering of the moire pattern.

As described above, by applying the variable range Δx of the moire vertical pitch, the electron beam transmission holes are arranged in the shadow mask with the two different pitches vertically alternating, so as to scatter the moire pattern to reduce the moire effect.

What is claimed is:

1. A shadow mask for use in a three-gun color picture tube comprising a number of electron beam transmission holes, the length of the bridge portion between two vertically adjacent ones of said electron beam transmission holes being constant, the vertical pitch of said electron beam transmission holes being varied between Py+Δx and Py−Δx so as to reduce moire effect, Δx being obtained from the relationship between the moire wavelength and vertical hole pitch of said shadow mask according to the following formula:

$$\lambda(\text{moire wavelength}) = \frac{1}{\left|\frac{2}{Py} - \frac{n}{2Ps}\right|} - \frac{1}{|fa - fs|}$$

wherein Py is the vertical pitch of the electron beam transmission holes of said shadow mask, Ps is the pitch of scanning lines of the electron beams, fa is the pitch frequency of the shadow mask, fs is the scanning frequency, and wherein Δx is selected as the range of variation of pitch Py about a midpoint located between successive intersecting nth order moire wavelength envelopes below a predetermined level related to the visibility of moire effects.

2. A shadow mask as claimed in claim 1, characterized in that two kinds of electron beam transmission holes are alternately and vertically positioned so as to make constant the sum of the pitches of two vertically adjacent electron beam transmission holes.

3. A shadow mask as claimed in claim 1, characterized in that the pitches of two vertically adjacent electron beam transmission holes have respectively the values of Py−Δx and Py+Δx.

4. A shadow mask as claimed in claim 1, characterized in that the pitches of two vertically adjacent electron beam transmission holes have respectively the values of Py+Δx sin (r) and Py+Δx cos (r), wherein r represents an arbitrarily measured vertical distance of a screen.

5. A shadow mask as claimed in claims 1, 3 or 4, characterized in that the variational range Δx is in the closed interval 0.03 mm $\leqq \Delta x \leqq$ 0.05 mm.

6. A shadow mask as claimed in one of claims 1 to 4, characterized in that two vertically adjacent electron beam transmission holes respectively have relatively small and large size.

7. A shadow mask as recited in claim 1 wherein Δx is selected as the range of variation about a midpoint located at the intersection of the 3rd and 4th order moire wavelength envelopes below a maximum moire wavelength of 5 mm.

* * * * *